US008082747B2

(12) United States Patent
Sjoholm et al.

(10) Patent No.: US 8,082,747 B2
(45) Date of Patent: Dec. 27, 2011

(54) TEMPERATURE CONTROL THROUGH PULSE WIDTH MODULATION

(75) Inventors: Lars I. Sjoholm, Burnsville, MN (US); Panayu R. Srichai, Minneapolis, MN (US)

(73) Assignee: Thermo King Corporation, Minneapolis, MN (US)

( * ) Notice: Subject to any disclaimer, the term of this patent is extended or adjusted under 35 U.S.C. 154(b) by 458 days.

(21) Appl. No.: 12/330,548

(22) Filed: Dec. 9, 2008

(65) Prior Publication Data

US 2010/0139301 A1 Jun. 10, 2010

(51) Int. Cl.

| | |
|---|---|
| ***F25B 1/00*** | (2006.01) |
| ***F25B 49/00*** | (2006.01) |
| ***F04B 49/00*** | (2006.01) |
| ***F01C 1/16*** | (2006.01) |

(52) U.S. Cl. ..... 62/228.5; 62/228.1; 62/228.3; 417/310; 418/201.2

(58) Field of Classification Search ..... 62/228.3, 62/228.1, 228.5, 196.1, 196.3; 417/310, 417/440; 418/201.2, 142

See application file for complete search history.

(56) References Cited

U.S. PATENT DOCUMENTS

| | | | | |
|---|---|---|---|---|
| 3,151,806 | A | 10/1964 | Whitfield | |
| 3,224,662 | A | 12/1965 | Oldberg | |
| 3,936,239 | A * | 2/1976 | Shaw | 417/315 |
| 4,102,150 | A | 7/1978 | Kountz | |
| 4,453,900 | A | 6/1984 | Schibbye et al. | |
| 4,538,421 | A | 9/1985 | Kawamoto | |
| 6,120,255 | A | 9/2000 | Schumann et al. | |
| 6,422,846 | B1 | 7/2002 | Zhong et al. | |
| 6,494,699 | B2 * | 12/2002 | Sjoholm et al. | 418/201.2 |
| 6,718,781 | B2 | 4/2004 | Freund et al. | |
| 6,745,584 | B2 | 6/2004 | Pham et al. | |
| 6,925,823 | B2 | 8/2005 | Lifson et al. | |
| 6,984,114 | B2 | 1/2006 | Zili et al. | |
| RE40,257 | E | 4/2008 | Doepker et al. | |
| 2003/0033823 | A1 * | 2/2003 | Pham et al. | 62/228.3 |
| 2006/0045752 | A1 | 3/2006 | Beckman | |
| 2008/0314055 | A1 * | 12/2008 | Lifson | 62/196.3 |

FOREIGN PATENT DOCUMENTS

| | | |
|---|---|---|
| GB | 1171291 | 11/1969 |
| JP | 10281534 A * | 10/1998 |

OTHER PUBLICATIONS

Sjoholm, Lars, Variable Volume-Ratio and Capacity Control in Twin-Screw Compressors, Purdue Compressor Technology conference, 1996.

* cited by examiner

*Primary Examiner* — Chen Wen Jiang

(74) *Attorney, Agent, or Firm* — Michael Best & Friedrich LLP

(57) ABSTRACT

A refrigerant compressor assembly for a refrigeration circuit controls the temperature within a temperature controlled space. The refrigerant compressor assembly includes a first unloading valve, a first valve actuator, and a first valve control system that adjusts the first valve actuator via a pulse-width-modulated signal, a second unloading valve, a second valve actuator, and a second valve control system that adjusts the second valve actuator via a pulse-width-modulated signal. The refrigerant compressor assembly also includes a third unloading valve. The first valve actuator is coupled to the first and third unloading valves and controlled by the first valve control system. The unloading valves selectively allow or resist fluid flow from higher to lower pressure areas within the refrigerant compressor assembly.

28 Claims, 6 Drawing Sheets

TEMPERATURE CONTROL THROUGH PULSE WIDTH MODULATION

BACKGROUND

The present invention relates to compressors, and more specifically to refrigerant compressors.

In conventional practice, refrigerant circuits include a refrigerant compressor. The cooling potential of the refrigeration circuit is at least partially determined by the suction pressure of the compressor, and the pressure discharged from the compressor is at least partially determined by the capacity of the compressor. In general, a larger compressor capacity will lead to a larger cooling potential of the refrigerant circuit.

Currently, a common way to adjust the cooling potential of a refrigerant circuit is to constrict flow through the suction port, thus decreasing the pressure present in the suction port. This process is known to those skilled in the art as suction pressure throttling and is accomplished by positioning a throttling valve before the suction port. The throttling valve reduces the mass flow entering the compressor and therefore lowers the cooling potential of the refrigerant circuit. This type of control is often employed with a variable throttling valve that allows control of the degree of throttling and thus variably controls the cooling potential of the system. This in turn allows control of the temperature of a temperature controlled space.

Conventional arrangements, such as ones incorporating suction pressure throttling, have many disadvantages including a lack of accurate temperature control in the frozen temperature range, and problems inherent with suction pressure throttling. One problem is potentially high pressure ratios resulting from very low suction port pressures, potentially causing damage to the compressor.

SUMMARY

The present invention is directed to controlling cooling potential by using unloading valves that actuate between closed and open positions. When open, an unloading valve allows fluid communication between thread volumes thus lowering the capacity of the compressor and affecting the cooling potential. When closed, the unloading valve allows the compressor to operate at full capacity. In addition, a controller can be used to control the refrigeration system of the present invention. In particular, pulse-width-modulation can be used to vary the capacity of the refrigerant compressor.

In one embodiment, the invention provides a refrigerant compressor assembly for a refrigeration circuit that controls the temperature within a temperature controlled space. The refrigerant compressor assembly includes a compressor unit which includes a housing, a drive member, and an idler member. The drive member and the idler member are supported by the housing and define a direction of increasing pressure within the housing. Also, one or more of the drive member, idler member, and the housing at least partially define a suction port, a first compression chamber disposed downstream of the suction port in the direction of increasing pressure, a second compression chamber disposed downstream of the first compression chamber in the direction of increasing pressure, and a discharge port disposed downstream of the second compression chamber in the direction of increasing pressure. The refrigerant compressor assembly also includes a first unloading valve that is in fluid communication with the first compression chamber, a first valve actuator that is coupled to the first unloading valve, and a first valve control system in electrical communication with the first valve actuator. The first valve control system is configured to adjust the first valve actuator via a pulse-width-modulated signal and controls the first valve actuator between a closed position which resists flow from the first compression chamber through the first unloading valve and an open position which allows flow from the first compression chamber to an upstream location relative to the direction of increasing pressure. In addition, the refrigerant compressor assembly includes a second unloading valve that is in fluid communication with the second compression chamber, a second valve actuator that is coupled to the second unloading valve, and a second valve control system in electrical communication with the second valve actuator. The second valve control system is configured to adjust the second valve actuator via a pulse-width-modulated signal and controls the second valve actuator between a closed position which resists flow from the second compression chamber through the second unloading valve and an open position which allows flow from the second compression chamber to an upstream location relative to the direction of increasing pressure.

In another embodiment, the invention provides a refrigerant compressor assembly for a refrigeration circuit that controls the temperature within a temperature controlled space. The refrigerant compressor assembly includes a compressor unit which includes a housing, a drive member, and an idler member. The drive member and the idler member are supported by the housing and define a direction of increasing pressure within the housing. Also, one or more of the drive member, idler member, and the housing at least partially define a suction port, a first compression chamber disposed downstream of the suction port in the direction of increasing pressure, a second compression chamber disposed downstream of the first compression chamber in the direction of increasing pressure, and a discharge port disposed downstream of the second compression chamber in the direction of increasing pressure. The refrigerant compressor assembly also includes a first unloading valve that includes a first fluid passageway that connects the first compression chamber and an upstream location relative to the direction of increasing pressure, and a second unloading valve that includes a second fluid passageway that connects the second compression chamber and an upstream location relative to the direction of increasing pressure. A valve actuator is coupled to the first unloading valve and the second unloading valve and is controlled by a valve control system which is in electrical communication with the valve actuator. The valve control system is configured to adjust the valve actuator to control the first unloading valve and the second unloading valve between a closed position that resists flow from the first compression chamber and the second compression chamber through the first fluid passageway and the second fluid passageway, and an open position that allows flow from the first compression chamber and the second compression chamber to the first fluid passageway and the second passageway.

In another embodiment, the invention provides a method of controlling a refrigerant compressor. The method includes compressing a refrigerant with a drive member and an idler member in a direction of increasing pressure, adjusting a first valve actuator via a pulse-width-modulated signal, controlling a first unloading valve with the first valve actuator between a closed position that resists flow from a first compression chamber through the first unloading valve and an open position that allows flow from the first compression chamber to an upstream location relative to the direction of increasing pressure, and adjusting a second valve actuator via a pulse-width-modulated signal and controlling a second unloading valve with the second valve actuator between a closed position that resists flow from a second compression chamber through the second unloading valve and an open position that allows flow from the second compression chamber to an upstream location relative to the direction of increasing pressure.

In another embodiment, the invention provides a method of controlling a refrigerant compressor. The method includes compressing a refrigerant with a drive member and an idler member in a direction of increasing pressure, adjusting a valve actuator, and controlling a first unloading valve and a second unloading valve with the valve actuator between a closed position that resists flow from a first compression chamber and a second compression chamber through the first unloading valve and the second unloading valve, and an open position that allows flow from the first compression chamber and the second compression chamber to an upstream location relative to the direction of increasing pressure.

Other aspects of the invention will become apparent to those skilled in the art by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Screw compressors and unloading valves are known and one such example is described in U.S. Pat. No. 6,494,699 issued Dec. 17, 2002, the entire content of which is incorporated by reference herein.

Figure 1:
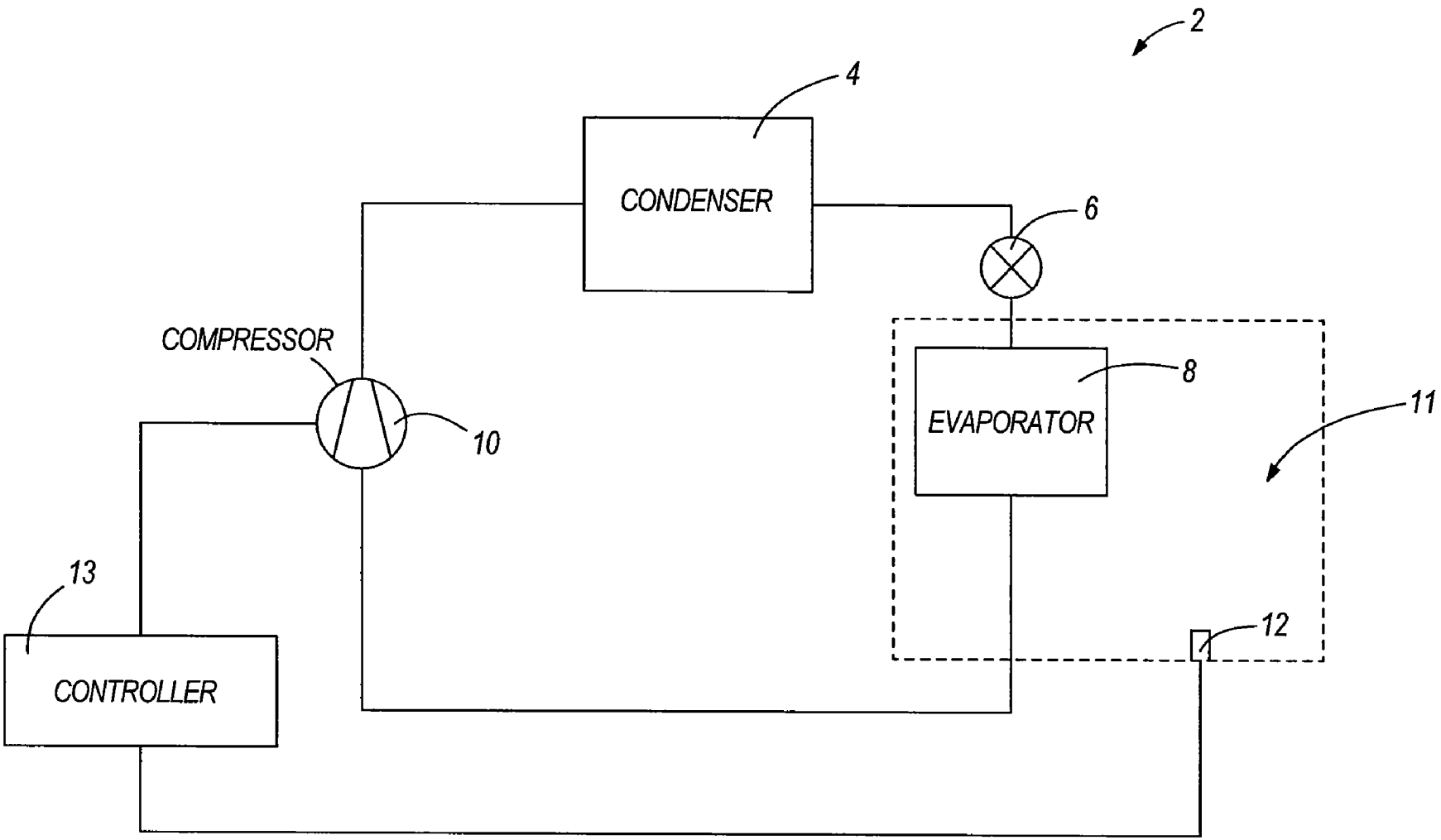
FIG. 1 is a schematic representation of a refrigeration system.

FIG. 1 illustrates a refrigeration circuit 2 that includes a condenser 4, an expansion valve 6, an evaporator 8, and a compressor 10. The evaporator 8 is housed in a temperature controlled space 11 and the refrigeration circuit 2 controls the temperature within the temperature controlled space 11. A sensor 12 is in thermal communication with the temperature controlled space 11 such that the sensor 12 accurately detects the temperature within the temperature controlled space 11 and sends a signal indicative of the detected temperature to a controller 13 that receives the signal. The controller 13 then controls the refrigeration circuit 2 to maintain a desired temperature within the temperature controlled space 11. Refrigeration circuits 2 are well known by those skilled in the art and may be applied to a wide variety of applications. As such, many alterations may be made to the illustrated system to optimize the configuration as needed. In other constructions, multiple sensors 12 can be used.

Figure 2:
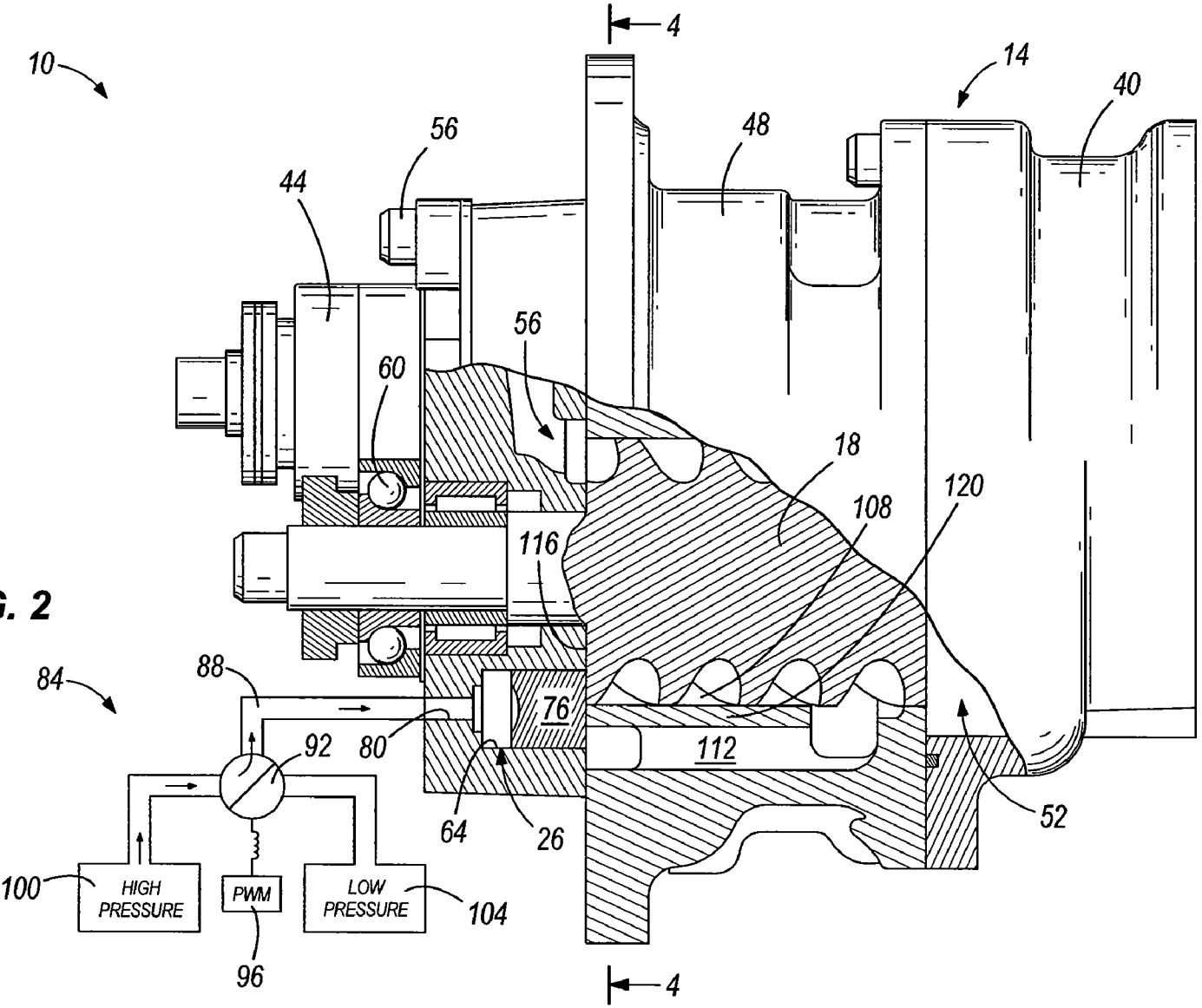
FIG. 2 is a partial section view of a screw compressor illustrating an unloading valve in a closed position.

FIG. 2 illustrates the compressor 10, which is a screw type compressor. The compressor 10 is used to move refrigerant through the refrigeration circuit 2 thereby controlling the temperature within the temperature controlled space 11. In other constructions, the compressor 10 may compress other fluids and may be used in other applications.

Figure 3:
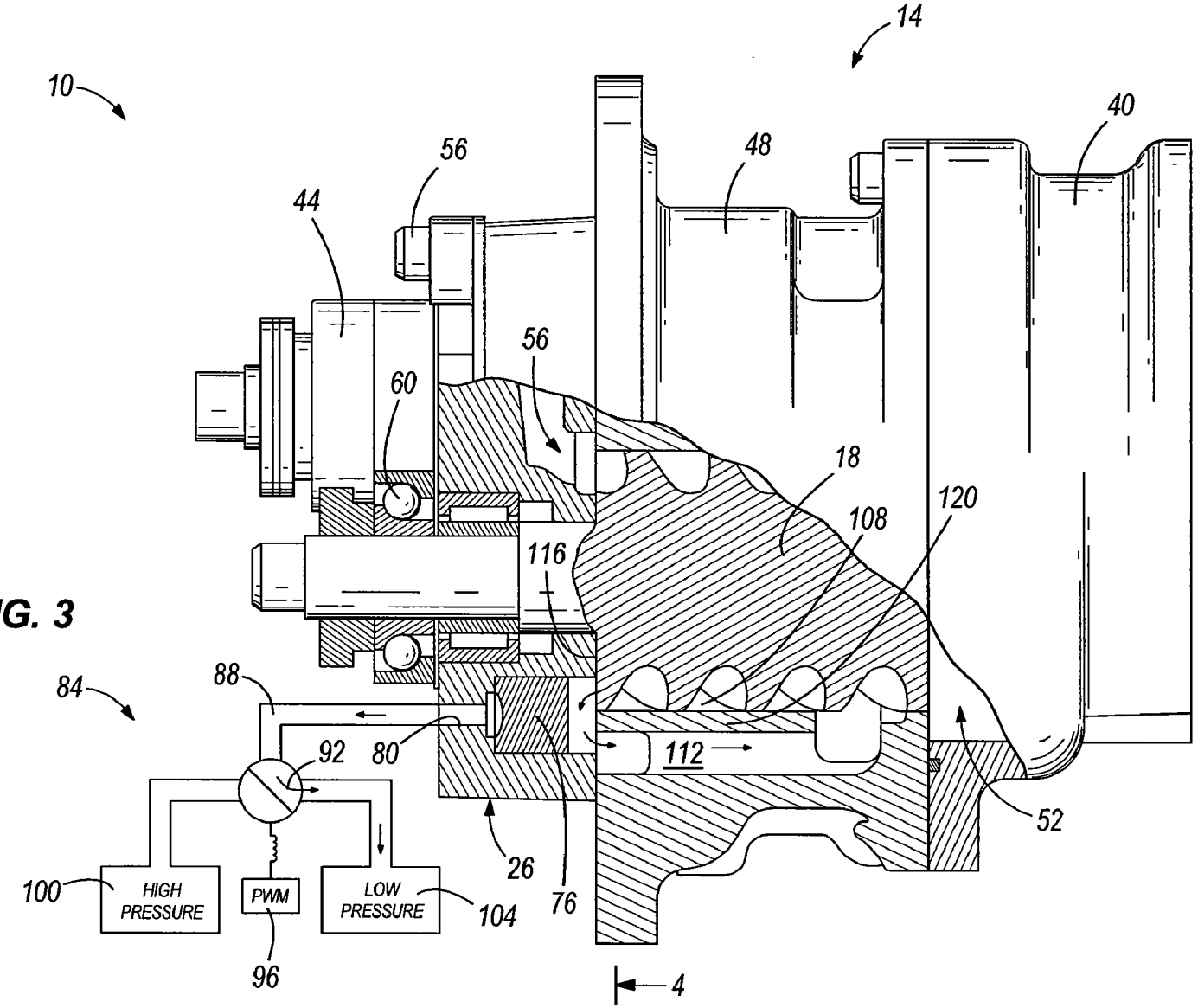
FIG. 3 is a partial sectional view similar to FIG. 2 of the screw compressor of FIG. 2 illustrating an unloading valve in an open position.
Figure 4:
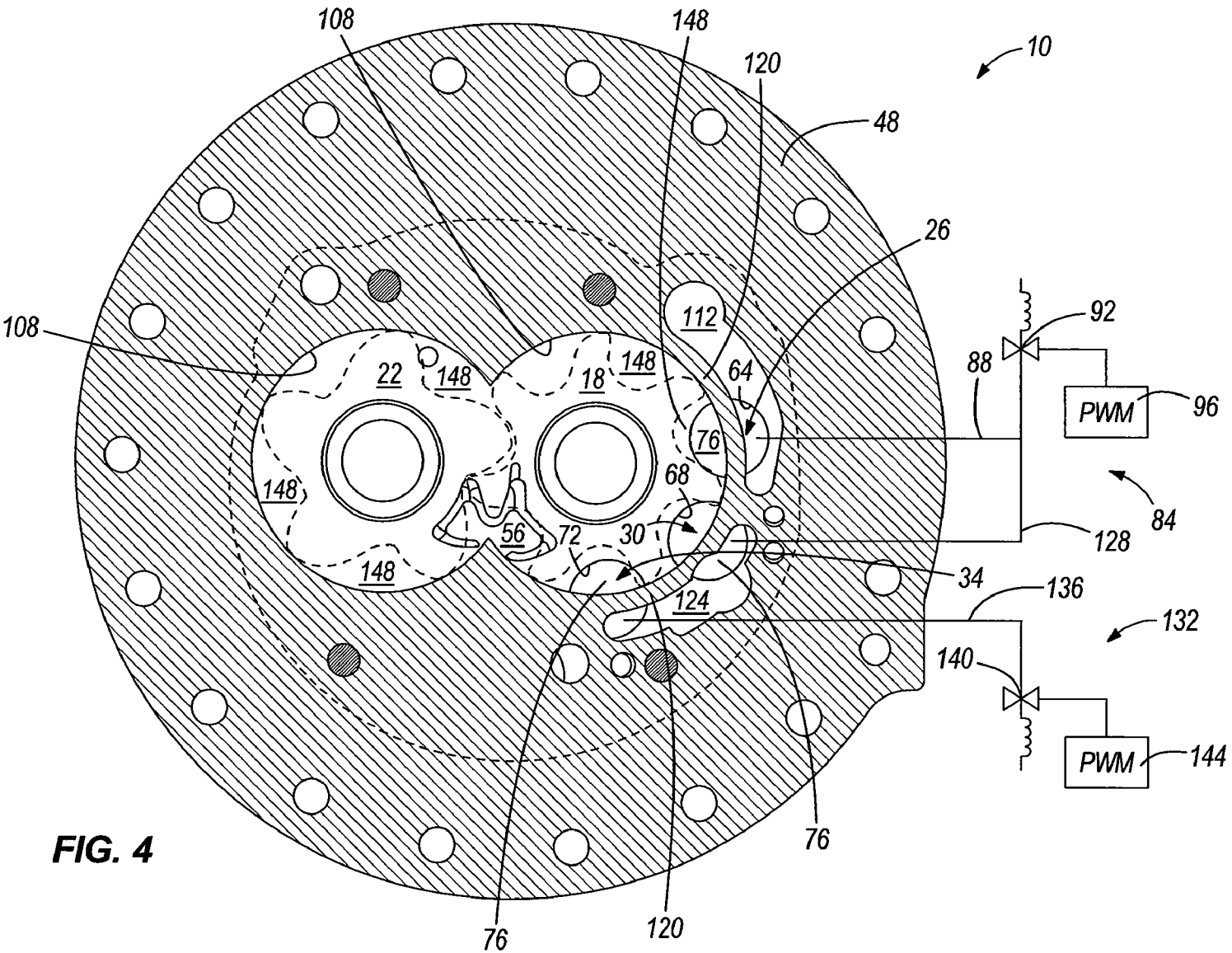
FIG. 4 is a sectional view of the screw compressor taken along the line 4-4 on FIG. 2.

The compressor 10, as shown in FIGS. 2 and 3, includes a housing 14, a drive member or drive screw 18, and an idler member or idler screw 22 (FIG. 4) to increase the pressure of the refrigerant and move the refrigerant through the compressor 10. With reference to FIG. 4, the compressor 10 includes a first unloading valve 26, a second unloading valve 30, and a third unloading valve 34 that are incorporated into the compressor housing 14 and arranged around the drive screw 18. In other constructions, it is conceivable to arrange the first unloading valve 26, the second unloading valve 30, and the third unloading valve 34 around either, or both the drive screw 18 and the idler screw 22. In addition, less than three unloading valves or more than three unloading valves are conceivable.

The illustrated housing 14 is formed from three separate pieces, a suction end piece 40, a discharge end piece 44, and a screw housing piece 48. The suction end piece 40, the discharge end piece 44, and the screw housing piece 48 are assembled to form the housing 14. A suction end chamber or suction port 52 is defined in the suction end piece 40 and contains low-pressure fluid and defines a low-pressure region. A discharge end chamber or discharge port 56 is defined in the discharge end piece 44 and contains high-pressure fluid and defines a high-pressure region. A direction of increasing pressure is defined in the direction away from the suction end piece 40 and toward the discharge end piece 44. The suction end piece 40 and the discharge end piece 44 each further contain a bored region sized to receive a bearing 60 which in turn supports either the drive screw 18 or the idler screw 22. FIGS. 2 and 3 show only the drive screw 18. In other constructions, the housing 14 may be formed of a different number of pieces.

Figure 7:
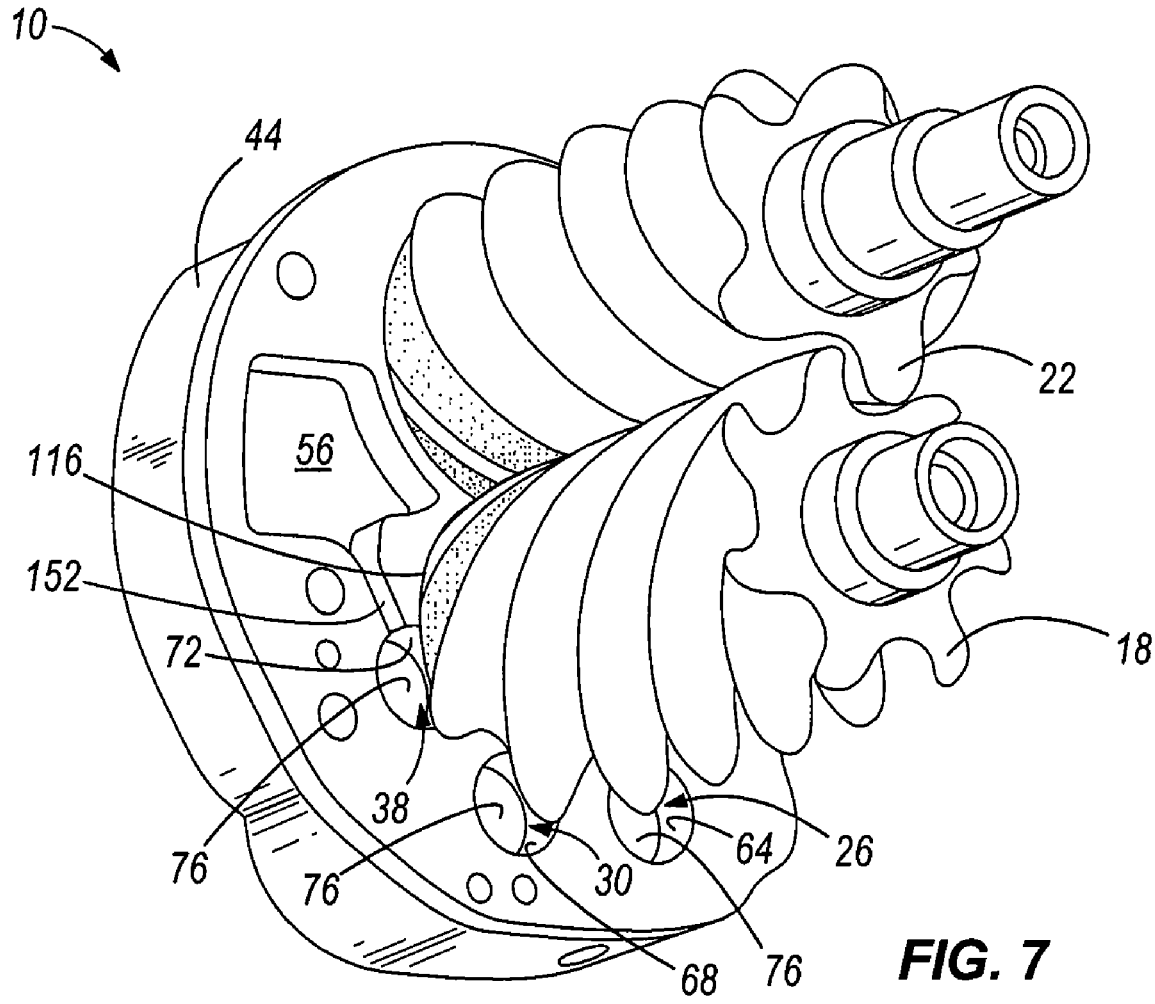
FIG. 7 is a view similar to FIG. 5 illustrating a minimum capacity arrangement.

With continued reference to FIGS. 2, 3, and 7, the first unloading valve 26 includes a first valve chamber 64 defined in the discharge end piece 44, the second unloading valve 30 includes a second valve chamber 68 defined in the discharge end piece 44, and the third unloading valve includes a third valve chamber 72 defined in the discharge end piece 44. Each of the first unloading valve 26, the second unloading valve 30, and the third unloading valve 34, includes an unloading valve member 76, sized to fit in each respective valve chamber.

The first unloading valve 26 will be described initially in detail. The second unloading valve 30 and the third unloading valve 34 function in a similar manner and will be described in more detail below. A first lift bore 80 fluidly connects the first valve chamber 64 to a first control fluid supply 84. The control fluid within the first control fluid supply 84 can be hydraulic oil, or any fluid compressed by the compressor 10, such as refrigerant.

The first control fluid supply 84 includes a first supply line 88, a first valve actuator or first solenoid valve 92, and a first valve control system 96 that is in electrical communication with the controller 13. The first supply line 88 fluidly connects the first lift bore 80 to the first solenoid valve 92 such that the control fluid may communicate between the first solenoid valve 92 and the first valve chamber 64. The first solenoid valve 92 is controlled by the first valve control system 96 such that the first solenoid valve 92 selectively connects a high pressure fluid source 100 or a low pressure fluid source 104 to the first supply line 88.

The first valve control system 96 uses pulse-width-modulation (PWM) to actuate the first solenoid valve 92. FIG. 2 shows the first solenoid valve 92 in a closed or loaded position where the high pressure fluid source 100 is in fluid communication with the first supply line 88 such that the unloading valve member 76 is held in the loaded position. In the preferred construction, the first valve control system 96 operates on a 10 second duty cycle with the smallest pulse width of 0.1 to 1 second. In other constructions, the duty cycle and smallest pulse width may be different to suit the needs of the specific system with which the compressor 10 is used.

FIG. 3 shows the first solenoid valve 92 in an open or unloaded position where the low pressure fluid source 104 is in fluid communication with the first supply line 88 such that the unloading valve member 76 is held in the unloaded position.

With further reference to FIG. 4, the screw housing piece 48 defines two large bores that form a screw cavity 108, which accommodates the drive screw 18 and the idler screw 22. A first vent passageway 112, parallel to the screw cavity 108, is defined in the screw housing piece 48 and provides a flow path from a high-pressure end 116 of the drive screw 18 to the suction port 52 when the first unloading valve 26 is in the unloaded position. The first vent passageway 112 can be any shape so long as it provides an adequate flow area for the first unloading valve 26 alone or in combination with other unloading valves, to unload the compressor 10. In addition, a wall 120, typically formed as part of the housing 14, exists between the first vent passageway 112 and the screw cavity 108. A second vent passageway 124 is spaced radially around the drive screw 18 and is in fluid communication with the second unloading valve 30 and the third unloading valve 34. In other constructions more or less than two vent passageways are conceivable.

The screw cavity 108 allows the drive screw 18 and the idler screw 22 to mesh while still providing enough clearance to allow free rotation of the drive screw 18 and the idler screw 22. The size of each bore is precisely controlled to achieve a minimum operating clearance between the bore, the drive screw 18, and the idler screw 22. Any excess clearance between the walls of the screw cavity 108 and the drive screw 18 or the idler screw 22 will reduce the compressor's 10 efficiency, volumetric output, and maximum pressure output. The positions of the first unloading valve 26, the second unloading valve 30, and the third unloading valve 34 are shown with respect to the drive screw 18 and the discharge end piece 44. In the preferred construction, the unloading valves 26, 30, 34 are arranged such that there is less than one pitch (screw thread or flute) between the first unloading valve 26 and the suction port 52, less than one pitch between the first unloading valve 26 and the second unloading valve 30, less than one pitch between the second unloading valve 30 and the third unloading valve 34, and less than one pitch between the third unloading valve 34 and the discharge port 56. In other constructions, the unloading valves 26, 30, 34 may be arranged differently. In addition, more than three unloading valves or less than three unloading valves are conceivable.

The first control fluid supply 84 is illustrated schematically and additionally includes a second supply line 128 that fluidly connects the first solenoid valve 92 to the second lift bore 68 to control the second unloading valve 30. A second control fluid supply 132, similar to the first control fluid supply 84, is also illustrated and includes a third supply line 136, a second valve actuator or second solenoid valve 140, and a second valve control system 144 that is in electrical communication with the controller 13. The third supply line 136 fluidly connects the third lift bore 72 to the second solenoid valve 140 such that the control fluid may communicate between the second solenoid valve 140 and the third valve chamber 72 to control the third unloading valve 34.

The second solenoid valve 140 is controlled by the second valve control system 144 such that the second solenoid valve 140 selectively connects one of the high pressure fluid source 100 and the low pressure fluid source 104 to the third supply line 136. The second valve control system 144 uses pulse-width-modulation (PWM) to actuate the second solenoid valve 140. In the preferred embodiment, the second valve control system 144 operates on a 10 second duty cycle with the smallest pulse width of 0.1 to 1 second. In other constructions, the duty cycle and smallest pulse width may be different to suit the needs of the specific system with which the compressor 10 is used.

To further reduce the capacity of the compressor 10, a slot 152 may be added between the third unloading valve 34 and the discharge port 56 such that when the third unloading valve 34 is in the unloaded position, fluid may flow from the third unloading valve 34 to the discharge port 56 independent of the rotation of the drive screw 18 and the idler screw 22. The cross section of the slot 152 is chosen such that the desired capacity and desired pressure differential for moving the third unloading valve 34 from the loaded position to the unloaded position is achieved. While the third unloading valve 34 is in the loaded position the slot 152 is closed and the pressure differential across the third unloading valve 34 is increased do to the relatively high pressure within the discharge port 56. The relatively high pressure differential causes the third unloading valve 34 to be "self-closing". In other embodiments, the slot 152 may be eliminated.

Figure 5:
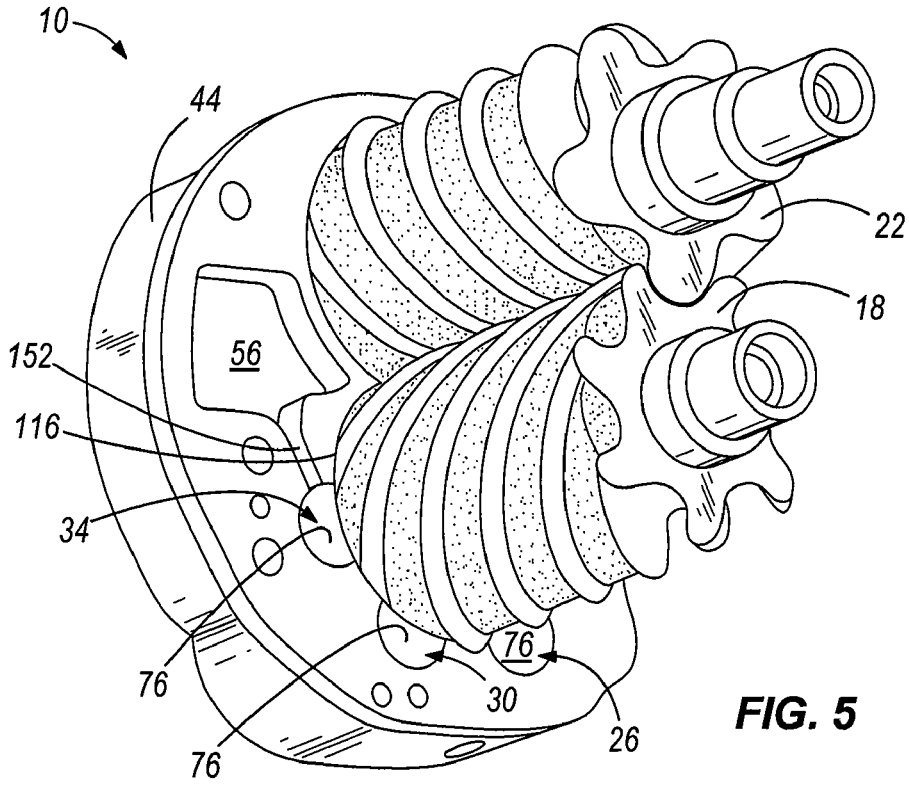
FIG. 5 is a perspective view of a portion of the screw compressor of FIG. 2 illustrating a maximum capacity arrangement.

In some embodiments, the compressor may include an economizer port 156. FIG. 5 shows the economizer port 156 in broken lines. The economizer port 156 is connected to an economizer circuit (not shown) in the refrigeration circuit 2. The economizer port 156 is allowed to open such that flow through the economizer port 156 to the economizer circuit is allowed when the first unloading valve 26 is in the unloaded position. In addition, the flow through the economizer port 156 is be proportional to the opening of the first unloading valve 26. The economizer port 156 provides an advantage when used with the screw compressor 10 as compared to a digital scroll compressor with an economizer because the scroll economizer has to be closed while entering into PWM mode. In other embodiments, the economizer port 156 may be eliminated.

In operation, the screw type compressor 10 uses the drive screw 18 and the idler screw 22 to move and pressurize fluid. The drive screw 18 and the idler screw 22 are in fluid communication with two regions within the suction end piece 40 and the discharge end piece 44. The suction cavity 52, or low-pressure region, contains a supply of low-pressure fluid, which is drawn into the drive screw 18 and the idler screw 22 during operation. The discharge port 56, or high-pressure region, located in the discharge end piece 44, collects the compressed fluid leaving the compressor 10.

The screw type compressor 10 compresses a fluid by trapping the fluid in a series of compression chambers 148 and then reducing the volume of the compression chambers 148, thus increasing the pressure therein. Rotation of the drive screw 18 and the idler screw 22 forces the fluid toward the high-pressure end 116 of the drive screw 18 and the idler screw 22 where it is discharged producing a continuous flow of high-pressure fluid. Typically, one screw, the drive screw 18, is coupled to an electric motor or other prime mover capable of turning the drive screw 18. Rotation of the drive screw 18 forces the idler screw 22, which is meshed with the drive screw 18, to turn. The drive screw 18 and the idler screw 22 working together trap and force the fluid to move toward the high-pressure region. The drive screw 18 and the idler screw 22 are sized to fit within the housing 14 such that there is very little endplay in the drive screw 18 or the idler screw 22. This means that the gap between the high-pressure end 116 of the drive screw 18 and the idler screw 22 and the housing 14 is small enough to prevent substantial leakage between adjacent compression chambers 148.

As the drive screw 18 and the idler screw 22 rotate, fluid is trapped in the compression chamber 148 formed between the mesh point of the drive screw 18, the idler screw 22, and the housing 14 at the high-pressure end 116. Continued rotation allows the end of the compression chamber 148 to eventually pass over the discharge cavity 56 and discharge the high-pressure fluid. If one of the unloading valves 26, 30, 34 is open at some point before the discharge cavity 56, the pressure within the compression chamber 148 will prematurely vent to the low pressure region through either the first vent passageway 112 or the second vent passageway 124. For example, if an unloading valve 26, 30, 34 were open at a point one-half of a revolution before the discharge cavity 56, the fluid would vent at that point. However, fluid remains within the compression chamber 148 at a pressure approximately equal to the pressure in the suction port 52. After the compression chamber 148 passes the open unloading valve 26, 30, 34, the high-pressure end 116 will again seal and the compression chamber 148 volume will continue to reduce. The continued rotation of the drive screw 18 and the idler screw 22, after passing the open unloading valve 26, 30, 34, will continue compressing the trapped fluid. Because the full rotation of the drive screw 18 and the idler screw 22 is not utilized in compressing the fluid, the outlet pressure will be less than the maximum achievable, and the effective lengths of the drive screw 18 and the idler screw 22 is reduced.

Figure 6:
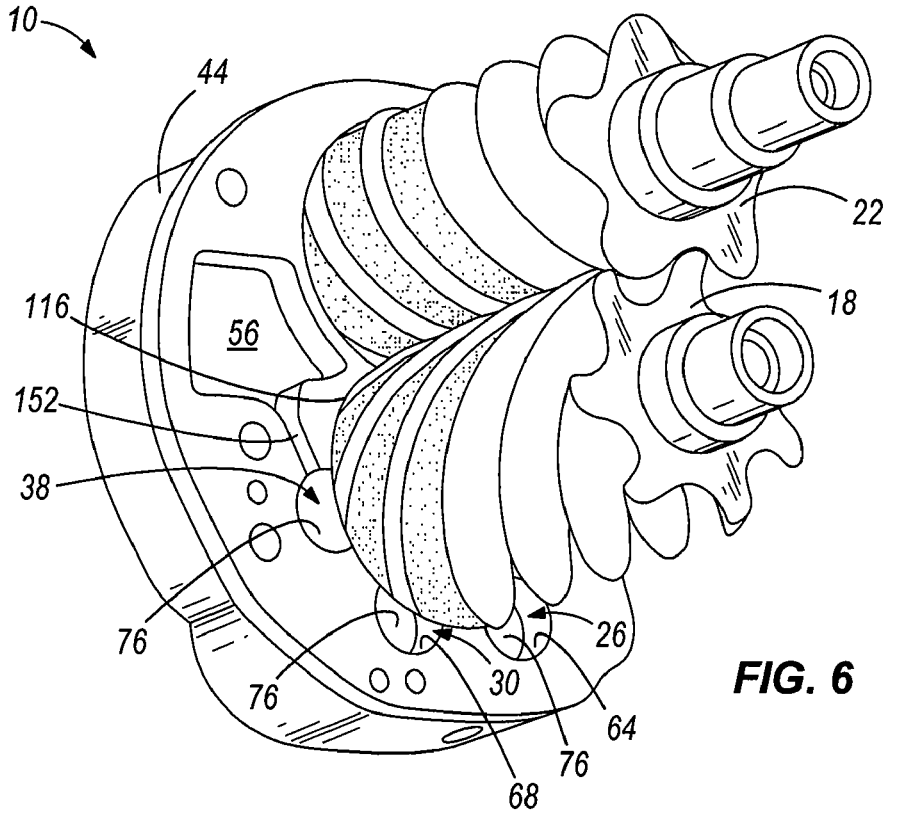
FIG. 6 is a view similar to FIG. 5 illustrating a moderate capacity arrangement.

Turning now to FIGS. 5-7, the operation of the compressor 10 will be described. FIG. 5 illustrates the compressor 10 in a maximum capacity mode or a pull-down state. In the maximum capacity mode, both the first valve control system 96 and the second valve control system 144 actuate the first solenoid valve 92 and the second solenoid valve 140, respectively, to fluidly connect the high pressure fluid source 100 with the first supply line 88, the second supply line 128, and the third supply line 136 such that the first unloading valve 26, the second unloading valve 30, and the third unloading valve 34 are all in the loaded position. In the maximum capacity mode, the compressor 10 is outputting the maximum pressure and volume of fluid or up to about 100 percent of full load capacity.

FIG. 6 illustrates the compressor 10 in a moderate capacity mode or a power-saver state. In the moderate capacity mode, the first valve control system 96 actuates the first solenoid valve 92 to fluidly connect the low pressure fluid source 104 with the first supply line 88 and the second supply line 128 such that the first unloading valve 26 and the second unloading valve 30 are in the unloaded position. The second valve control system 144 actuates the second solenoid valve 140 to fluidly connect the high pressure fluid source 100 with the third supply line 136 such that the third unloading valve 34 is in the loaded position. In the moderate capacity mode, the compressor 10 is outputting about 50 to 75 percent of full load capacity. In other constructions, different configurations of the invention could be used to change the load capacity to meet requirements.

FIG. 7 illustrates the compressor 10 in a minimum capacity mode or a set-point state. In the minimum capacity mode, both the first valve control system 96 and the second valve control system 144 actuate the first solenoid valve 92 and the second solenoid valve 140, respectively, to fluidly connect the low pressure fluid source 104 with the first supply line 88, the second supply line 128, and the third supply line 136 such that the first unloading valve 26, the second unloading valve 30, and the third unloading valve 34 are all in the unloaded position. In the minimum capacity mode, the compressor 10 is outputting about 1 to 10 percent of full load capacity. In other constructions, different configurations of the invention could be used to change the load capacity to meet requirements.

In the arrangements shown in FIGS. 5-7, the position of the first unloading valve 26, the second unloading valve 30, and the third unloading valve 34 directly affect a discharge pressure that is present in the discharge port 56. This in turn affects the cooling capacity of the refrigeration circuit 2 in which the compressor 10 is used.

When used in the refrigeration circuit 2, the compressor 10 runs the maximum capacity mode and the moderate capacity mode for continuous capacity control at high pressure ratio situations giving temperature control in the frozen range with constant air flow, high ambient head pressure control, and engine loading control. This control is maintained while the third unloading valve 34 is in the loaded position.

The compressor 10 can also operate between the maximum capacity mode, the moderate capacity mode, and the minimum capacity mode to provide continuous capacity control at low pressure ratio situations giving temperature control in the fresh range with constant air flow. This arrangement enables fresh temperature control by reducing the effective displacement of the compressor 10 while still maintaining relatively low pressure ratios on the compressor 10 thus avoiding the potentially high pressure ratios and other problems associated with suction pressure throttling.

The controller 13 allows the compressor 10 to operate between the modes illustrated in FIGS. 5-7 and maintain a high degree of temperature control accuracy by using pulse-width-modulation. The first valve control system 96 and the second valve control system 144 use pulse-width-modulated signals to actuate the first solenoid valve 92 and the second solenoid valve 140 respectively. Briefly, pulse-width-modulated (PWM) signals are square waves of high or low power. The preferred embodiment implements a 10 second cycle or period, and uses step increments of 0.1 to 1 second. This means the first valve control system 96 may operate, for example, the first solenoid valve 92 at a high power level for 5 out of every 10 seconds (i.e. a 50 percent duty cycle). This arrangement may translate to the first unloader valve 26 actuating to the unloaded position for 5 out of 10 seconds during that cycle. This arrangement will produce a different average discharge pressure than an arrangement with a high power level 7 out of every 10 seconds (i.e. a 70 percent duty cycle). In this way, the compressor 10 can offer a wide range of pressure output variability and within the refrigeration circuit 2 can control the temperature within the temperature controlled space 11 between the frozen range and the fresh range to a good degree of accuracy. In other constructions, the cycle or period may be longer or shorter as needed to meet the design requirements of the system in which the compressor 10 is used.

Another benefit associated with the compressor 10 is the ability to handle a flooded start with ease. In the preferred embodiment, the unloading valves 26, 30, 34 are arranged with less than one pitch (screw thread or flute) between the suction port 52 and the first unloading valve 26, less than one pitch between the first unloading valve 26 and the second unloading valve 30, less than one pitch between the second unloading valves 30 and the third unloading valve 34, and less than one pitch between the third unloading valve 34 and the discharge port 56. According to this arrangement, a first volume is defined at the suction port 52 and a second volume is defined downstream of the suction port 52 in the direction of increasing pressure. In the preferred embodiment, the second volume is defined at the discharge port 56. The ratio of the first volume to the second volume defines a volume ratio, as is well known by those skilled in the art.

Typically, the volume ratio of a screw compressor is defined as the volume of a compression chamber 148 at the start of the compression process to the volume of the same compression chamber 148 when it first begins to open to the discharge port 56. In the preferred arrangement, with the first unloading valve 26, the second unloading valve 30, and the third unloading valve 34 all in the unloaded position, the volume ratio of the compressor 10 is less than one.

With reference to FIG. 4, the arrangement of the unloading valves 26, 30, 34 makes a volume ratio of less than one possible. The first volume is a constant value defined by the compression chamber 148 as defined by the volume of a screw thread when the screw thread is positioned in fluid communication with the suction port 52. The second volume is variable and in the preferred embodiment, may be larger than the first volume when all the unloading valves 26, 30, 34 are in the unloaded position. The screws 18, 22 are arranged such that there is less than one pitch between each of the discharge port, the unloading valves 26, 30, 34, and the suction port 52 and both the third unloading valve 34 and the second unloading valve are in fluid communication with the second vent passageway 124. When the third unloading valve 34, the second unloading valve 30, and the first unloading valve 26 are in the unloaded position, the second volume is defined by the compression chamber 148 as defined by the volume of all the screw threads in fluid communication with the discharge port 56. For example, while all unloading valves 26, 30, 34 are in the unloaded position, the discharge port 56 is in direct fluid communication with a first thread, in indirect fluid communication with a second thread via the third unloading valve 34, in indirect fluid communication with a third thread via the second unloading valve 32, and in indirect fluid communication with a fourth thread via the first unloading valve 26. The first volume remains constant but the second volume may include four thread volumes all connected by the unloading valves 26, 30, 34 and the vent passageways 112, 124 such that the second volume is greater than the first volume. In this situation, the volume ratio is less than one. In other embodiments, different arrangements and configurations may result in a similar effect.

Many screw compressors utilize a helical step-up-gear (not shown) to drive the drive screw 18. In the event the helical step-up-gear is used with the screw compressor 10 of the invention, the helix should be selected in such a way that the axial force enacted on the drive screw 18 by the helical step-up-gear is in the same direction as the axial gas force enacted on the drive screw 18 when all the unloading valves 26, 30, 34 are in the unloaded position. In the preferred construction, the drive screw 18 includes a left-hand helix gear (not shown) that meshes with the helical step-up-gear. The threads of the corresponding drive screw 18 would then have a right-hand helix pattern. This arrangement stabilizes the drive screw 18 at a maximum unloaded condition when all the unloading valves 26, 30, 34 are in the unloaded position. This arrangement also makes the screw compressor 10 less sensitive to torque pulses from an engine during the maximum unloaded condition.

As will be understood by those skilled in the art, the invention may be practiced on other compressor types including scroll compressors.

Various features and advantages of the invention are set forth in the following claims.

What is claimed is:

1. A refrigerant compressor assembly for a refrigeration circuit for controlling a temperature within a temperature controlled space, the refrigerant compressor assembly comprising:

a compressor unit including:

a housing;

a drive member supported by the housing;

an idler member supported by the housing and driven by the drive member to compress refrigerant defining a direction of increasing pressure, at least one of the housing, the drive member, and the idler member at least partially defining:

a suction port;

a first compression chamber disposed downstream of the suction port in the direction of increasing pressure;

a second compression chamber disposed downstream of the first compression chamber in the direction of increasing pressure;

a discharge port disposed downstream of the second compression chamber in the direction of increasing pressure;

a first unloading valve in fluid communication with the first compression chamber;

a first valve actuator coupled to the first unloading valve;

a first valve control system in electrical communication with the first valve actuator, the first valve control system configured to adjust the first valve actuator via a pulse-width-modulated signal to control the first unloading valve between a closed position resisting flow from the first compression chamber through the first unloading valve and an open position allowing flow from the first compression chamber to an upstream location relative to the direction of increasing pressure;

a second unloading valve in fluid communication with the second compression chamber;

a second valve actuator coupled to the second unloading valve; and a second valve control system in electrical communication with the second valve actuator, the second valve control system configured to adjust the second valve actuator via a pulse-width-modulated signal to control the second unloading valve between a closed position resisting flow from the second compression chamber through the second unloading valve and an open position allowing flow from the second compression chamber to an upstream location relative to the direction of increasing pressure, wherein there is less than one pitch between the first unloading valve and the second unloading valve, and wherein there is less than one pitch between the second unloading valve and the discharge port.

2. The refrigerant compressor assembly of claim 1, wherein the compressor unit is a screw type compressor.

3. The refrigerant compressor assembly of claim 1, wherein the first valve actuator is a solenoid valve in fluid communication with a high pressure fluid and a low pressure fluid, the solenoid valve operable to selectively expose the first unloading valve to at least one of the high pressure fluid and the low pressure fluid to control the first unloading valve between the open and closed positions.

4. The refrigerant compressor assembly of claim 1, wherein each pulse-width-modulated signal is based on at least one of the temperature within the temperature controlled space and a property of the refrigerant within the refrigeration circuit.

5. The refrigerant compressor assembly of claim 1, wherein the discharge port includes a discharge port pressure, the discharge port pressure being varied by the position of the first unloading valve and the second unloading valve.

6. The refrigerant compressor assembly of claim 5, wherein the refrigerant compressor is configured to control the temperature within the temperature controlled space by varying the discharge port pressure.

7. A refrigerant compressor assembly for a refrigeration circuit for controlling a temperature within a temperature controlled space, the refrigerant compressor assembly comprising:

a compressor unit including:

a housing;

a drive member supported by the housing;

an idler member supported by the housing and driven by the drive member to compress refrigerant defining a direction of increasing pressure, at least one of the housing, the drive member, and the idler member defining:

a suction port;

a first compression chamber disposed downstream of the suction port in the direction of increasing pressure;

a second compression chamber disposed downstream of the first compression chamber in the direction of increasing pressure;

a discharge port disposed downstream of the second compression chamber in the direction of increasing pressure;

a first unloading valve including a first fluid passageway connecting the first compression chamber and an upstream location relative to the direction of increasing pressure;

a second unloading valve including a second fluid passageway connecting the second compression chamber and an upstream location relative to the direction of increasing pressure;

a valve actuator coupled to the first unloading valve and the second unloading valve; and a valve control system in electrical communication with the valve actuator, the valve control system configured to adjust the valve actuator to control the first unloading valve and the second unloading valve between a closed position resisting flow from the first compression chamber and the second compression chamber through the first fluid passageway and the second fluid passageway, and an open position allowing flow from the first compression chamber and the second compression chamber to the first fluid passageway and the second fluid passageway.

8. The refrigerant compressor assembly of claim 7, wherein the valve actuator is controlled via a pulse-width-modulated signal.

9. The refrigerant compressor assembly of claim 7, wherein the compressor unit is a screw type compressor.

10. The refrigerant compressor assembly of claim 7, wherein the first unloading valve and the second unloading valve are linked in parallel such that the valve actuator is configured to actuate both the first unloading valve and the second unloading valve substantially simultaneously.

11. The refrigerant compressor assembly of claim 7, wherein there is less than one pitch between the suction port and the first unloading valve, and where there is less than one pitch between the first unloading valve and the second unloading valve.

12. The refrigerant compressor assembly of claim 7, wherein the valve actuator is a solenoid valve in fluid communication with a high pressure fluid and a low pressure fluid, the solenoid valve operable to selectively expose the first unloading valve and the second unloading valve to at least one of the high pressure fluid and the low pressure fluid to control the first unloading valve and the second unloading valve between the open and closed positions.

13. The refrigerant compressor assembly of claim 7, wherein the pulse-width-modulated signal is based on at least one of the temperature within the temperature controlled space and a property of the refrigerant within the refrigeration circuit.

14. The refrigerant compressor assembly of claim 7, wherein the discharge port includes a discharge port pressure, the discharge port pressure being varied by the position of the first unloading valve and the second unloading valve.

15. The refrigerant compressor assembly of claim 14, wherein the pulse-width-modulated signal is configured to control the temperature within the temperature controlled space by varying the discharge port pressure of the compressor unit.

16. The refrigerant compressor assembly of claim 7, wherein a first volume is defined at the suction port and a second volume is defined downstream in the direction of increasing pressure, the ratio of the first volume to the second volume defining a volume ratio, the volume ratio at least partially dependant on the position of the first unloading valve and the second unloading valve, the volume ratio being less than 1 when the first unloading valve and the second unloading valve are open.

17. A method of controlling a refrigerant compressor, the method comprising:

compressing a refrigerant with a drive member and an idler member in a direction of increasing pressure;

adjusting a first valve actuator via a pulse-width-modulated signal;

controlling a first unloading valve with the first valve actuator between a closed position resisting flow from a first compression chamber through the first unloading valve and an open position allowing flow from the first compression chamber to an upstream location relative to the direction of increasing pressure;

adjusting a second valve actuator via a pulse-width-modulated signal; and controlling a second unloading valve with the second valve actuator between a closed position resisting flow from a second compression chamber through the second unloading valve and an open position allowing flow from the second compression chamber to an upstream location relative to the direction of increasing pressure, wherein there is less than one pitch between the first unloading valve and the second unloading valve, and wherein there is less than one pitch between the second unloading valve and a discharge port.

18. The method of claim 17, further comprising selectively exposing the first unloading valve to at least one of a high pressure fluid and a low pressure fluid to control the first unloading valve between the open position and the closed position.

19. The method of claim 17, further comprising basing the pulse-width-modulated signal on at least one of a temperature within a temperature controlled space and a property of the refrigerant within the refrigeration compressor.

20. The method of claim 17, further comprising varying the position of the first unloading valve and the second unloading valve to vary a discharge port pressure as measured at the discharge port.

21. The method of claim 20, further comprising controlling a temperature within a temperature controlled space by varying the discharge port pressure.

22. A method of controlling a refrigerated compressor, the method comprising:

compressing a refrigerant with a drive member and an idler member in a direction of increasing pressure;

adjusting a valve actuator; and controlling a first unloading valve and a second unloading valve with the valve actuator between a closed position resisting flow from a first compression chamber and a second compression chamber through the first unloading valve and the second unloading valve, and an open position allowing flow from the first compression chamber and the second compression chamber to an upstream location relative to the direction of increasing pressure.

23. The method of claim 22, further comprising controlling the valve actuator via a pulse-width-modulated signal.

24. The method of claim 23, further comprising basing the pulse-width-modulated signal on at least one of a temperature within a temperature controlled space and a property of the refrigerant within the refrigeration compressor.

25. The method of claim 22, further comprising configuring the first unloading valve and the second unloading valve in parallel such that they may be controlled by the valve actuator substantially simultaneously.

26. The method of claim 22, further comprising selectively exposing the first unloading valve and the second unloading valve to at least one of a high pressure fluid and a low pressure fluid to control the first unloading valve and the second unloading valve between the open and closed positions.

27. The method of claim 22, further comprising varying the position of the first unloading valve and the second unloading valve to vary a discharge port pressure as measured at a location downstream of the second compression chamber.

28. The method of claim 27, further comprising controlling a temperature within a temperature controlled space by varying the discharge port pressure.

* * * * *